United States Patent [19]

Arendt et al.

[11] 4,096,001

[45] Jun. 20, 1978

[54] BORON-CONTAINING ELECTRICAL STEEL HAVING A CALCIUM BORATE COATING AND MAGNESIA OVERCOATING, AND PROCESS THEREFOR

[75] Inventors: Ronald H. Arendt; Matthew J. Curran, both of Schenectady, N.Y.

[73] Assignee: General Electric Company, Schenectady, N.Y.

[21] Appl. No.: 774,806

[22] Filed: Mar. 7, 1977

[51] Int. Cl.[2] ..... H01F 1/04

[52] U.S. Cl. ..... 148/113; 148/31.5; 204/40; 428/471; 428/633

[58] Field of Search ..... 204/37, 40; 428/469, 428/471, 633; 148/12.1, 27, 31.5, 113, 122, 112, 111; 427/127, 132

[56] References Cited

U.S. PATENT DOCUMENTS

| | | | |
|---|---|---|---|
| 2,354,123 | 7/1944 | Horstman et al. | 148/113 |
| 3,054,732 | 9/1962 | McQuade | 204/37 |
| 3,379,581 | 4/1968 | Kohler et al. | 148/113 |
| 3,676,227 | 7/1972 | Matsumoto et al. | 148/111 |
| 3,700,506 | 10/1972 | Tanaka et al. | 148/111 |
| 3,905,842 | 9/1975 | Grenoble | 148/111 |
| 4,030,950 | 6/1977 | Shilling et al. | 148/112 |

*Primary Examiner*—Walter R. Satterfield
*Attorney, Agent, or Firm*—C. T. Watts; J. T. Cohen; M. Snyder

[57] ABSTRACT

A relatively thin coat of calcium metaborate is electrolytically-applied directly to the surface of a boron-containing electrical steel and a substantially thicker overcoat of $Mg(OH)_2$ is electrolytically-deposited on the calcium metaborate coating to provide a duplex coating about 0.2 mil thick.

9 Claims, 1 Drawing Figure

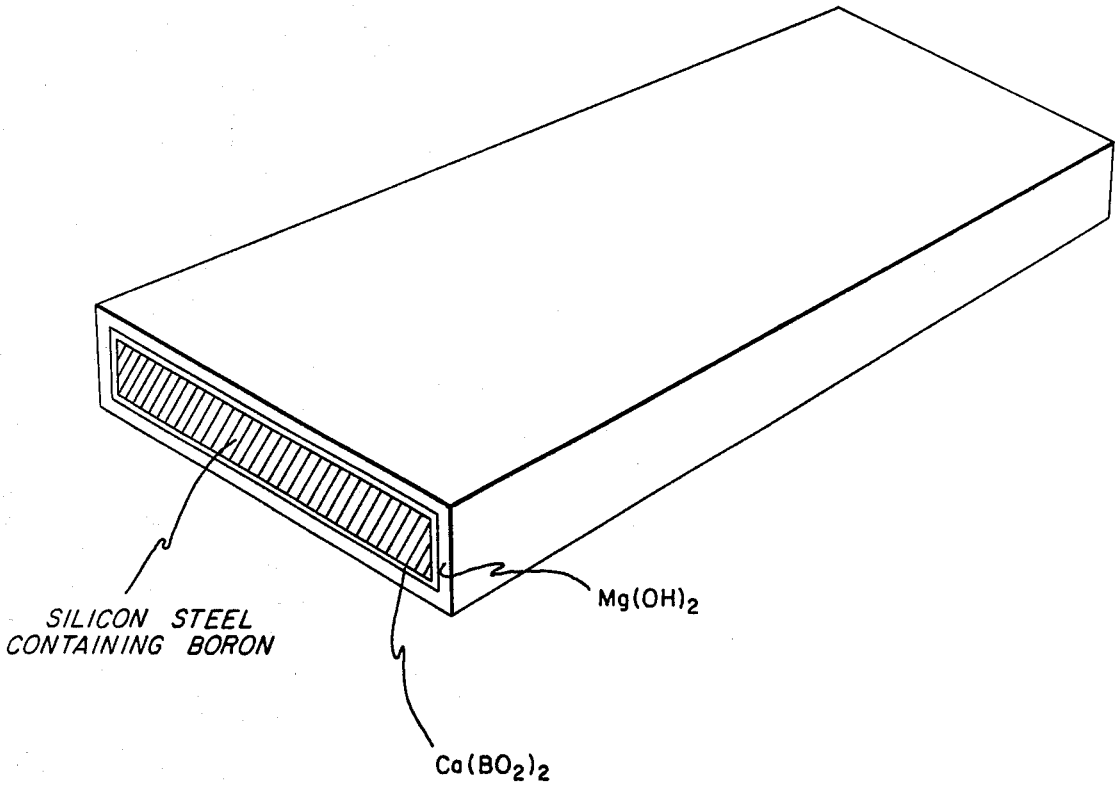
SILICON STEEL
CONTAINING BORON
$Mg(OH)_2$
$Ca(BO_2)_2$

BORON-CONTAINING ELECTRICAL STEEL HAVING A CALCIUM BORATE COATING AND MAGNESIA OVERCOATING, AND PROCESS THEREFOR

The present invention relates generally to the art of producing electrical steel and is more particularly concerned with a novel method of electrolytically depositing a boron-containing electrically-insulating coating on a boron-containing silicon-iron magnetic sheet, and with the unique coated silicon-iron product made by that method.

CROSS REFERENCES

This invention is related to the invention disclosed and claimed in U.S. Pat. Application Ser. No. 774,807 filed of even date herewith in the names of Ronald H. Arendt and Matthew J. Curran entitled, "Coated Silicon-Iron Product and Process Therefor" and assigned to the assignee hereof and directed to the novel concept of providing on a boron-containing electrical steel a "duplex" refractory electrically-insulating coating of a primary layer of an electrolytically-deposited layer of a boron-containing $Mg(OH)_2$ and a somewhat thicker secondary layer or overcoat of electrolytically-deposited $Mg(OH)_2$.

This invention is also related to the invention disclosed and claimed in U.S. Pat. Application Ser. No. 774,808 filed of even date herewith in the names of Ronald H. Arendt and Patrick F. Aubourg entitled, "Silicon-Iron Production and Composition and Process Therefor" and assigned to the assignee hereof and directed to the novel concept of electrolytically codepositing $Mg(BO_2)_2$ and $Mg(OH)_2$ on boron-containing electrical steel sheet or strip material.

BACKGROUND OF THE INVENTION

Following the discovery by Grenoble (U.S. Pat. No. 3,905,842 granted Sept. 16, 1975 and assigned to the assignee hereof) that boron is effective in small but critical amount and in critical proportion to nitrogen in silicon-iron to promote secondary recrystallization during the final texture-developing anneal, Maucione (U.S. Pat. Application Ser. No. 677,147, filed Apr. 15, 1976 and also assigned to the assignee hereof) found that the presence of a very small amount of boron in the coating on such a boron-containing steel further promotes secondary recrystallization and development of still better magnetic properties in the ultimate product. Maucione further found that the presence of boron in the coating can cause secondary recrystallization to take place when it otherwise would not, and also discovered that the presence of boron in the insulating coating was not effective in causing or promoting secondary recrystallization in the absence of boron in the metal itself at the outset of the final anneal.

In the practice of Maucione's teachings, boron has been incorporated in the refractory oxide coating, usually magnesium hydroxide [$Mg(OH)_2$], provided in accordance with the process disclosed and claimed by McQuade in U.S. Pat. No. 3,054,732 by a dipping operation or by brushing a solution of a suitable boron compound on the coating, or even spraying it on.

Then, through the discovery by Arendt and Aubourg that a boron-containing compound and $Mg(OH)_2$ can be electrolytically codeposited as described and claimed in their patent application referred to above, it became possible to exercise better control over the amount of boron incorporated in the insulating coating and also to more uniformly distribute the boron throughout the coating. As another important advantage of this codeposition method, the resulting product has a surface which is more amenable to fabrication operations customarily involved in the use of electrical steel.

SUMMARY OF THE INVENTION

In accordance with our discoveries to be described, it is possible to enhance substantially the beneficial effect on the ultimate sheet product of boron in the coating without losing the foregoing advantages of the Maucione and the Arendt and Aubourg inventions. In particular, we have found that a coating of calcium metaborate [$Ca(BO_2)_2$] can be applied electrolytically through the use of a homogeneous solution of calcium acetate and boric acid buffered with solid $Ca(BO_2)_2$ at a temperature of at least 65° C and preferably about 95° C. Further, we have found that $Ca(BO_2)_2$ in coating form is effective to prevent egress of boron from the silicon-iron sheet during the final anneal and that by providing a coating of $Mg(OH)_2$ over the $Ca(BO_2)_2$ coating it is possible to retain the boron in place in proximity to the sheet surface during the critical early stages of the final anneal even though the overcoating itself contains little or no boron at all. Thus, the boron essential to the secondary recrystallization of the silicon-iron during the texture-developing anneal is retained in the metal without incurring the offsetting disadvantages of having either a coating which is not thick enough to provide the insulating property required or a coating which contains a total quantity of boron which is detrimental to the magnetic properties of the ultimate silicon-iron sheet product.

We have discovered in addition that the primary coating of this invention serves effectively to getter sulfur in the silicon-iron substrate to further enhance the magnetic properties of the ultimate sheet material.

Still further, we have found that satisfactory coatings and the new advantages of this invention can be consistently produced and obtained only if the temperature of the electrolytes are maintained throughout the deposition operations at 65° C or higher and preferably about 90°-95° C.

This invention has both method and article or product aspects, the method centering in the novel feature of sequential $Ca(BO_2)_2$ and $Mg(OH)_2$ electrolytic deposition. The product is the $Mg(OH)_2$ - and $Ca(BO_2)_2$-—coated boron-containing silicon-iron body produced by the sequential deposition process of this invention.

Briefly described, then, the new method of this invention comprises the steps of providing a boron-containing electrical steel, electrolyzing a $Ca(BO_2)_2$-buffered aqueous solution of calcium acetate and boric acid to pH less than 7.0 with the silicon-iron sheet material being arranged as the cathode in the solution and with the solution being at a temperature of at least about 65° C and thereby covering the sheet with an adherent, relatively thin, electrically-insulating coating of $Ca(BO_2)_2$, then with the resulting coated sheet arranged as the cathode in an aqueous solution consisting essentially of magnesium acetate buffered with solid MgO electrolytically depositing a substantially thicker coating of $Mg(OH)_2$ on the said coating sheet, and thereafter subjecting the resulting double-coated sheet to a final heat treatment, subjecting the resulting coated sheet to a final heat treatment to develop (110) [001] secondary recrystallization texture in the silicon-iron sheet.

Similarly described, the article of this invention is the duplex-coated, primary recrystallized, boron-containing silicon-iron sheet product of the sequential deposition steps of the process of this invention.

DETAILED DESCRIPTION OF THE INVENTION

As illustrated by the drawing accompanying and forming a part of this specification, this invention is carried out using a boron-containing electrical steel sheet substrate and applying thereto a substantially uniform, relatively thin coating of $Ca(BO_2)_2$ and then applying a $Mg(OH)_2$ coating of somewhat greater thickness to the resulting coated sheet material.

As the initial step in the process, the substrate metal sheet is provided by preparing a silicon-iron melt of the required chemistry and then casting and hot rolling to intermediate thickness. Thus, the melt on pouring will contain from 2.2 to 4.5 percent silicon, manganese and sulfur in amounts in a ratio of manganese to sulfur less than 2.3, from about three to 50 parts per million boron and about 15 to 95 ppm nitrogen in the ratio range to boron of one and 15 parts to one, the remainder being iron and small amounts of incidental impurities including carbon, aluminum, copper and oxygen. Following anneal, the hot band is cold rolled with or without intermediate anneal to final gauge thickness and then decarburized.

The resulting fine-grained, primary-recrystallized, silicon-iron sheet material in whatever manner produced is processed to provide the essential boron containing coating of this invention in preparation for the final texture-developing anneal. Processing at this point involves the critical use of the applicants' present discoveries and this invention process of electrolytically depositing an initial coating of $Ca(BO_2)_2$ and then a secondary and somewhat heavier or thicker coating of $Mg(OH)_2$. With the sheet material connected as a cathode and the circuit as described in the above-referenced U.S. Pat. No. 3,054,732 and immersed in an electrolyte of calcium acetate and boric acid buffered with solid $Ca(BO_2)_2$, a coating of $Ca(BO_2)_2$ of substantially uniform thickness is formed over the entire surface of the sheet in contact with the electrolyte. A coating of $Mg(OH)_2$ is similarly electrolytically deposited over the $Ca(BO_2)_2$ coating to a total thickness between about 0.10 and 0.40 mil, the $Ca(BO_2)_2$ initial coat being the thinner of the two at between about 0.02 and 0.07 mil.

As the final step of the process of this invention, the double- or duplex-coated sheet is heated in hydrogen or a mixture of nitrogen and hydrogen to cause secondary grain growth which begins at about 950° C. As the temperature is raised at about 50° C per hour to 1000° C, the recrystallization process is completed and heating may be carried on to up to 1175° C if desired to insure complete removal of residual carbon, sulfur and nitrogen.

The following illustrative, but not limiting, examples of our novel process as actually carried out with the new results indicated above will further inform those skilled in the art of the nature and special utility of this invention:

EXAMPLE I

Eleven-mil strips of silicon-iron of the following composition were prepared as described in U.S. Pat. No. 3,095,843, referred to above:

Carbon: 0.030%
Manganese: 0.035%
Sulfur: 0.031%
Boron: 0.0010%
Nitrogen: 0.0050%
Copper: 0.24%
Aluminum: 0.005%
Iron: Remainder From this melt composition, 10.7 mil sheets were produced in a series of hot rolling passes followed by pickling and annealing of the intermediate thickness sheet material (about 100 mils) and cold rolling to 60 mils thickness, whereupon the material was reheated and cold rolled again to final thickness and the cold-worked sheet was given a decarburizing heat treatment at 800° C for 8 minutes in hydrogen (room temperature dew point).

Epstein strips cut from the sheet to provide nine Epstein packs were immersed in an electrolyte prepared by adding boric acid and $Ca(BO_2)_2$ to a 10% aqueous solution of calcium acetate in distilled water. Sufficient boric acid was added to the solution to raise the pH to about 7.0.

The strips were made cathodes in electric circuits, 8 volts being applied across the terminals at a current density of 90 amperes per square foot for varying lengths of time to provide $Ca(BO_2)_2$ coatings of the thicknesses set forth in Table I. On removal of the strips from the primary coating electrolytes, they were placed in magnesium acetate electrolytes as described in U.S. Pat. No. 3,054,732, the coated strips again being cathodes in electric circuits and 8 volts again being applied across the terminals until the coating mass of $Mg(OH)_2$ deposited on the strips was as also indicated in Table I.

After annealing in hydrogen for about 8 hours at 1175° C, the duplex-coated strips had the magnetic properties stated in Table I.

TABLE I

| | | Losses, mwpp | | Coating Densities (mg/strip) | |
|---|---|---|---|---|---|
| Pack | μ10 Oe | 15 kG | 17 kG | $Ca(BO_2)_2$ | $Mg(OH)_2$ |
| 1 | 1889 | 500 | 645 | 2.2 | 72.3 |
| 2 | 1891 | 503 | 651 | 4.9 | 68.2 |
| 3 | 1890 | 489 | 632 | 6.1 | 72.2 |
| 4 | 1887 | 498 | 651 | 8.8 | 92.7 |
| 5 | 1885 | 505 | 660 | 9.6 | 62.8 |
| 6 | 1886 | 501 | 649 | 9.8 | 62.0 |
| 7 | 1890 | 489 | 629 | 12.0 | 60.4 |
| 8 | 1889 | 503 | 657 | 15.4 | 47.0 |
| 9 | 1885 | 511 | 676 | 21.8 | 34.6 |

As is apparent from comparison of these data with those set out in Tables I and II of copending patent application Ser. No. 774,807, the results obtained through the process of the present invention are generally the same as those obtained through the use of the $Mg(OH)_2$—$Mg(BO_2)_2$ duplex coating method of the invention of that companion case of ours.

EXAMPLE II

The process of this invention was tested again in a similar manner except that a total of 25 randomly selected Epstein packs from different steel heats and coils were treated as described in Example I to provide the initial $Ca(BO_2)_2$ coating and the heavier $Mg(OH)_2$ overcoat in the ranges of density (i.e., thickness) of mill practice involving the procedure of Example III of Maucione patent application Ser. No. 677,147. Thus, each strip had a total coating density of 0.025 to 0.030 ounce per square foot (steel) of which the primary $Ca(BO_2)_2$coat constituted about 15%. Also, the final anneal was that of usual practice involving heating in hydrogen to cause secondary grain growth starting at about 950° C, the temperature being raised about 50° C per hour to 1000° C when recrystallization is completed and going on up to 1175° C as stated in Example I. The magnetic properties of the resulting strips are compared in Table II with those of strip processed in accordance with the aforesaid Example III of the Maucione patent application.

TABLE II

| | μ10 Oe | Losses, mwpp 17 kG |
|---|---|---|
| Maucione EX. III Process | 1881 | 704 |
| Present Invention Process | 1891 | 704 |

Those skilled in the art will recognize that coating weight or thickness is commonly expressed in terms of density in ounces per square foot of steel strip surface and that 0.0275 oz/ft$^2$ = 77 milligrams per Epstein strip. Further, it is generally understood that 77 mg/Epstein strip corresponds to uniform coating thickness of 0.05 mil.

What we claim as new and desire to secure by Letters Patent of the United States is:

1. The method of producing grain-oriented silicon-iron sheet which comprises the steps of providing a fine-grained, primary-recrystallized, silicon-iron sheet containing 2.2 to 4.5 percent silicon, between about three and 50 parts per million boron, and between about 15 and 95 parts per million nitrogen in the ratio to boron of one to 15 parts per part of boron, electrolyzing an aqueous solution consisting essentially of calcium acetate and boric acid with solid $Ca(BO_2)_2$ with the silicon-iron sheet being arranged as the cathode in said solution and the said solution being at a temperature of at least about 65° C and thereby covering the sheet with an adherent electrically-insulating coating of $Ca(BO_2)_2$, then electrolyzing an aqueous solution consisting essentially of solid magnesia-buffered magnesium acetate with the resulting coated sheet arranged as the cathode in said magnesium acetate solution and thereby covering the $Ca(BO_2)_2$ coating with a substantially thicker $Mg(OH)_2$ coating, and thereafter subjecting the resulting double coated sheet to a final heat treatment to develop (110) [001]secondary recrystallization texture in the silicon-iron sheet.

2. The method of claim 1 in which the boron content of the silicon-iron sheet is between about 10 and 30 parts per million.

3. The method of claim 1 in which the boron content of the silicon-iron sheet is about 10 parts per million and the nitrogen content of the said sheet is about 30 parts per million.

4. The method of claim 1 in which the electrolyte is maintained at a temperature between about 90° and 95° C during the period of electrolytic codeposition.

5. The method of claim 1 in which the $Ca(BO_2)_2$ primary coating is about 0.02 to 0.07 mil thick and the $Mg(OH)_2$ secondary layer or overcoat is about 0.10 to 0.18 mil thick.

6. The method of claim 5 in which the total thickness of the electrically-insulating coatings is between about 0.10 and 0.40 mil thick.

7. The method of claim 5 in which the total thickness of the two electrolytically-deposited coatings is about 0.20 mil.

8. The double-coated, primary-recrystallized, silicon-iron sheet of the process of claim 1.

9. The calcium borate-coated grain-oriented silicon-iron sheet product of the process of claim 5.

* * * * *